US009193048B1

(12) United States Patent
Ellringer, II

(10) Patent No.: US 9,193,048 B1
(45) Date of Patent: Nov. 24, 2015

(54) WIRE NUT TOOL

(71) Applicant: John M. Ellringer, II, Midwest City, OK (US)

(72) Inventor: John M. Ellringer, II, Midwest City, OK (US)

( * ) Notice: Subject to any disclaimer, the term of this patent is extended or adjusted under 35 U.S.C. 154(b) by 449 days.

(21) Appl. No.: 13/986,301

(22) Filed: Apr. 19, 2013

(51) Int. Cl.

| | |
|---|---|
| ***B25B 13/00*** | (2006.01) |
| ***B25B 13/02*** | (2006.01) |
| ***B25B 23/16*** | (2006.01) |
| ***B25B 23/06*** | (2006.01) |
| ***B25B 23/02*** | (2006.01) |
| ***B25B 23/04*** | (2006.01) |
| ***B25B 13/50*** | (2006.01) |

(52) U.S. Cl.
CPC ..... *B25B 23/06* (2013.01); *B25B 13/5091* (2013.01); *B25B 23/02* (2013.01); *B25B 23/04* (2013.01); *B25B 23/065* (2013.01)

(58) Field of Classification Search
CPC .... B25B 13/5091; B25B 23/02; B25B 23/04; B25B 23/06; B25B 23/065
USPC ..... 81/124.2, 125, 177.4, 121.1; 29/748, 29/750
See application file for complete search history.

(56) References Cited

U.S. PATENT DOCUMENTS

| | | | | |
|---|---|---|---|---|
| 4,252,036 | A | 2/1981 | Vanderhoof | |
| 4,860,618 | A | 8/1989 | Givot | |
| 5,590,574 | A * | 1/1997 | Lide | B25B 13/065 81/124.1 |
| 5,887,631 | A | 3/1999 | Eaton | |
| 5,974,916 | A | 11/1999 | Lassiter | |
| D431,984 | S | 10/2000 | Cortillon | |
| 6,198,049 | B1 | 3/2001 | Korinek | |
| D480,283 | S | 10/2003 | Brown | |
| 6,922,887 | B1 | 8/2005 | Keswani | |
| 7,069,820 | B2 | 7/2006 | Goacher | |
| 7,127,970 | B2 * | 10/2006 | Kirchgaessler | B25B 13/5091 81/120 |
| 7,356,914 | B2 * | 4/2008 | Keswani | B25B 13/48 29/747 |
| D573,426 | S | 7/2008 | DeRuntz | |
| 7,413,693 | B2 | 8/2008 | Goacher | |

* cited by examiner

*Primary Examiner* — Bryan R Muller
(74) *Attorney, Agent, or Firm* — Randal D. Homburg

(57) ABSTRACT

A tool for the application and removal of a wire nut from a plurality of wire ends being connected together, the tool providing a handle with a grip end for increased grip and torsion applied to the tool and a lower tool end defining a hollow lower opening leading into a hollow cylindrical cavity within which a stack of wire nuts may be placed, the cavity supplying an internal spring to urge against the stacked wire nuts positioning the last wire nut into the opening for application, the cavity defining axial grooves within an internal wall of the cavity, temporarily securing the winged extension of the wing nuts during the twisting motions involved in the application and removal of the wire nuts until an intentional release of the secured wire nut from the tool.

2 Claims, 4 Drawing Sheets

WIRE NUT TOOL

CROSS REFERENCE TO RELATED APPLICATIONS

None.

I. BACKGROUND OF THE INVENTION

1. Field of Invention

A tool for the application and removal of a wire nut from a plurality of wire ends being connected together, the tool providing a handle with a grip end for increased grip and torsion applied to the tool and a lower tool end defining a hollow lower opening leading into a hollow cylindrical cavity within which a stack of wire nuts may be placed, the cavity supplying an internal spring to urge against the stacked wire nuts positioning the last wire nut into the opening for application, the cavity defining axial grooves within an internal wall of the cavity, temporarily securing the winged extension of the wing nuts during the twisting motions involved in the application and removal of the wire nuts until an intentional release of the secured wire nut from the tool.

2. Description of Prior Art

A preliminary review of prior art patents was conducted by the applicant which reveal prior art patents in a similar field or having similar use. However, the prior art inventions do not disclose the same or similar elements as the present wire nut tool, nor do they present the material components in a manner contemplated or anticipated in the prior art.

A majority of the prior art patents pertaining to the application or removal of a wire nut from a twisted wire bundle provide a tool with a socket on a tool end to accept a single wire nut and apply rotational forces upon the winged extensions of the wire nut to rotate the wire nut using forces greater than the simple grasp of the hand. These type tools include U.S. Pat. No. D576,426 to DeRuntz and U.S. Pat. No. 4,860,618 to Givot. Similar patents having an extension handle are found in U.S. Pat. Nos. D480,283 to Brown and D431,984 to Cotillon. Defined socket wire nut drivers attaching to a drill are disclosed in U.S. Pat. No. 6,922,887 to Keswani, U.S. Pat. No. 5,974,916 to Lassiter and U.S. Pat. No. 5,887,631 to Eaton. In U.S. Pat. Nos. 7,413,693 and 7,069,820 to Goacher, Jr., a hollow cylindrical tool defining dual tool ends is adapted to two different sized wire nut and providing a fully extending hollow bore for the insertion of a ground wire through the tool is indicated with an outer textured surface to improve grip of the tool. A torque limiting wire nut socket, as disclosed in U.S. Pat. No. 6,198,049 to Korinek, is applied to a proprietary wire nut defining a modified top portion to the wire nut, is inserted upon the special wire nut top and applies a limited force upon the wire nut until a specific amount of torque is reached, the socket then abrading a portion of the wire nut to the point that the socket cannot continue to grasp the upper portion of the special wire nut to prohibit over-rotation of the wire nut on the twisted wire bundle.

II. SUMMARY OF THE INVENTION

A standard wire nut is applied to the ends of a gather wire bundle to twist and retain the wires together for a secure electrical connection. The wire nuts define an inner diminishing tapered cavity, often including an inner threading or a tapered spring, an outer plastic insulating material and two axially extending winged extensions. Two or more wires are placed within the cavity and the two winged extensions are grasped by the fingers, rotating the wire nut to twist and secure the wires together with the wire nuts covering the exposed metal wiring of the twisted wire bundle. removing the wire nut requires the opposite rotational motion. These wire nuts are used in high and low voltage electrical wiring applications and the wire nuts are supplied in different sizes depending on the gauge of wires being attached or the number of wires being secured. They may also differ based upon the type of wiring, solid single or multiple strand.

There are certain tasks that require the application of multiple wire nuts. During this repetitive application of wire nuts, fatigue of the hand is common. Additionally, application of a wire nut with one's bare hands places the hand in close proximity to the exposed wiring, some wiring tasks requiring the application of the wire nut on live electrical wires or in remote locations. The prior art tools resolve the fatigue aspect of wire nut applications by providing a means of capturing a single wire nut within a socket with the opposing end grasped by and hand to apply a rotational force to the tool, applying or removing the wire nut. Some of them provide an extension handle or an opening for the insertion of a drill adapter. These tools provide for the application of a single wire nut, with the next wire nut requiring insertion and application, one wire nut at a time. None of the prior art tools provide for the insertion a plurality of stacked wire nuts, with the tool further providing for the single installation of the last wire nut in the stack nor a means to present the next wire nut for application, the stack being loaded, stored and retained within the wire nut tool providing for the ability to apply multiple wire nuts with one hand and avoid having to load one wire nut at a time for the convenience of the user.

III. DESCRIPTION OF THE DRAWINGS

The following drawings are submitted with this utility patent application.

IV. DESCRIPTION OF THE PREFERRED EMBODIMENT

Figure 1:
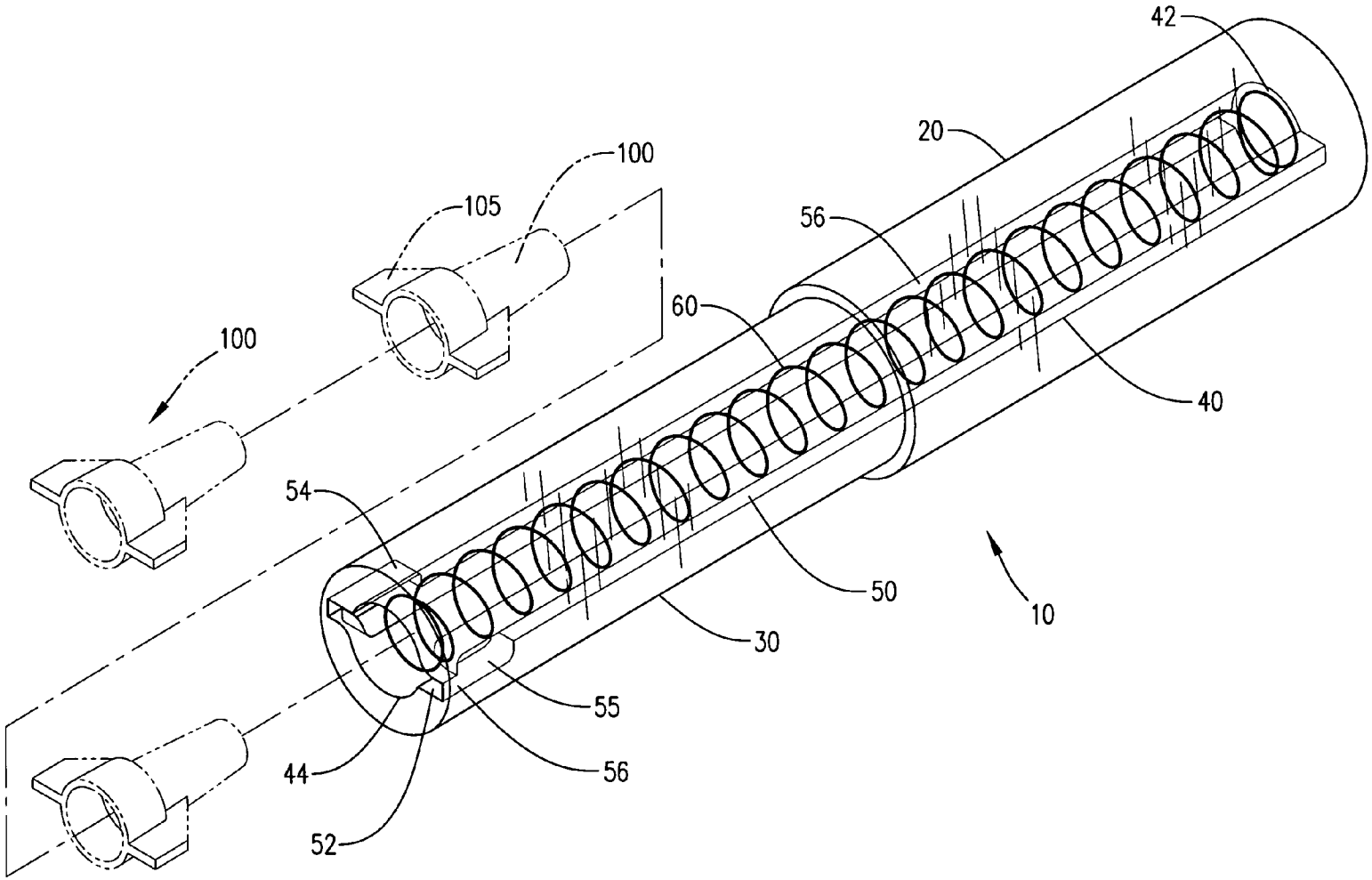
FIG. 1 is a perspective view of a transparent material wire nut application tool indicating the interior of the tool, with phantom lines showing wire nut connectors for insertion within the tool.
Figure 2:
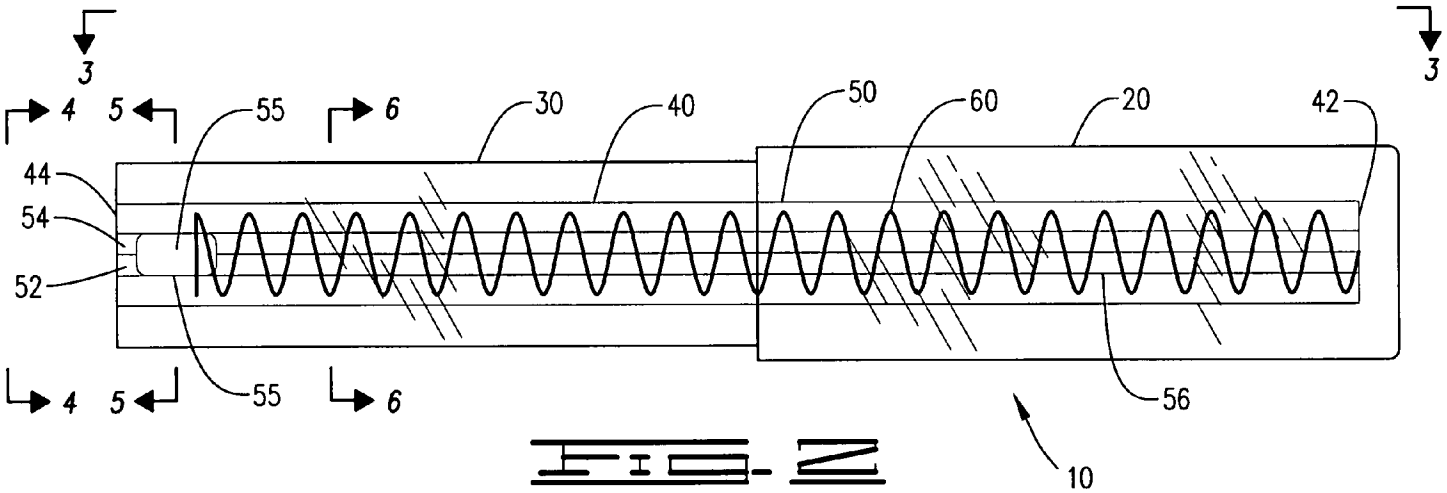
FIG. 2 is a side view of the transparent wire nut application tool indicting the interior of the tool, with the inner expansion spring in a fully extended position without any wire nuts within the hollow channel.
Figure 3:
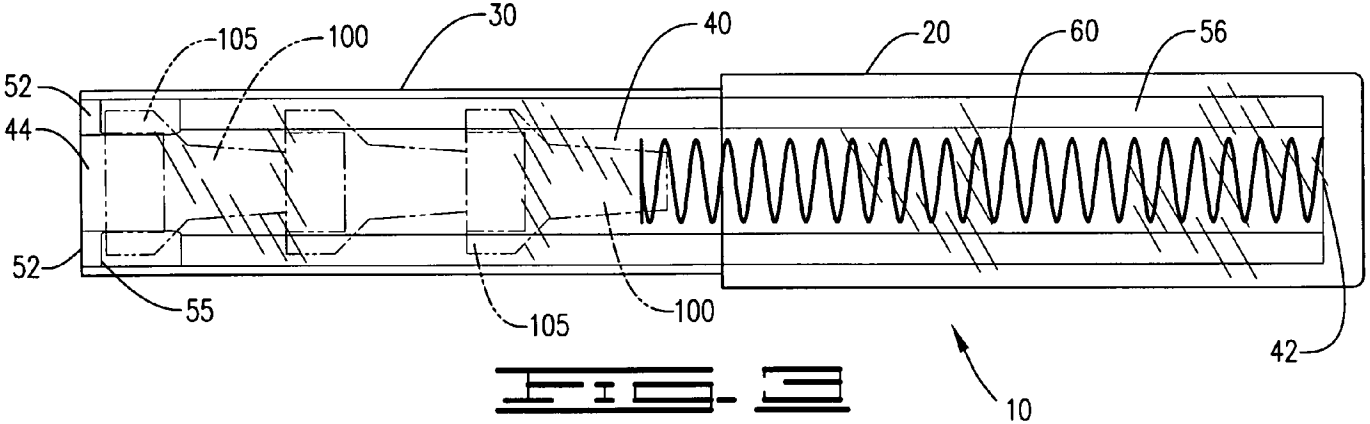
FIG. 3 is a side view of the transparent wire nut application tool containing three wire nut connectors shown in phantom line, with the inner expansion spring shown in a state of partial compression.
Figure 4:
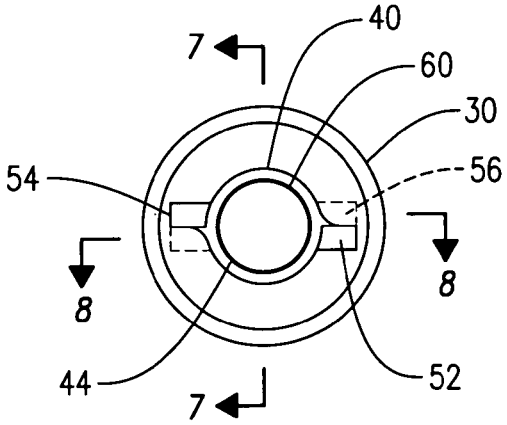
FIG. 4 is a cross sectional view of the wire nut application tool along section lines 4/4 of FIG. 2.
Figure 5:
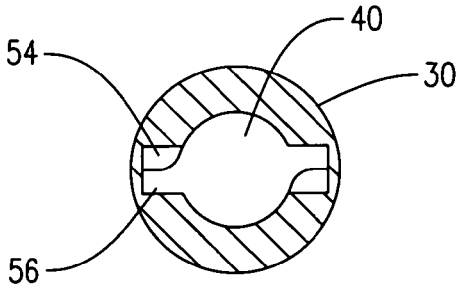
FIG. 5 is a cross sectional view of the wire nut application tool along section lines 5/5 of FIG. 2.
Figure 6:
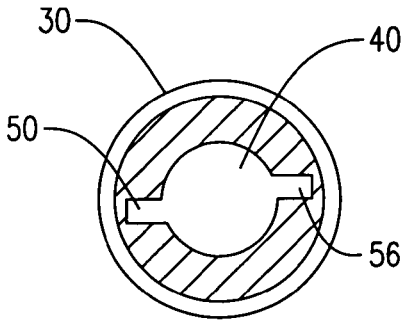
FIG. 6 is a cross sectional view of the wire nut application tool along section lines 6/6 of FIG. 2.

A wire nut application tool 10 for applying and removing wire nut connectors 100, as indicated in FIGS. 1-8 of the drawings, the tool 10 comprising an expanded handle portion 20 and a lower tool portion 30, the tool 10 defining a hollow channel 40 housing an inner expansion spring 60 which is biased against and attached to a channel end 42, the channel 40 further aligning a pair of perpendicular and axially aligned linear grooves 50 and forming a channel opening 44 including a terminal end 52 of each linear groove 50, each linear groove 50 further defining an extended interior segment 56 into the expanded handle portion downward within the hollow channel 40 towards the opening 44 into an offset groove shoulder 55 and laterally extending a release slot 54 forming the terminal end 52, wherein a plurality of wire nut connectors 100, defining a pair of radially aligned wire nut extensions 105 are be loaded within the hollow channel 40 with each wire nut extension 105 retained within each respective linear groove 50 with the lowest of the plurality of wire nut connectors 100 having the wire nut extensions 105 contemporaneously held upon each respective offset groove shoulder 55, FIG. 3, during application or removal from a wire bundle, not shown, using the tool 10.

Figure 7:
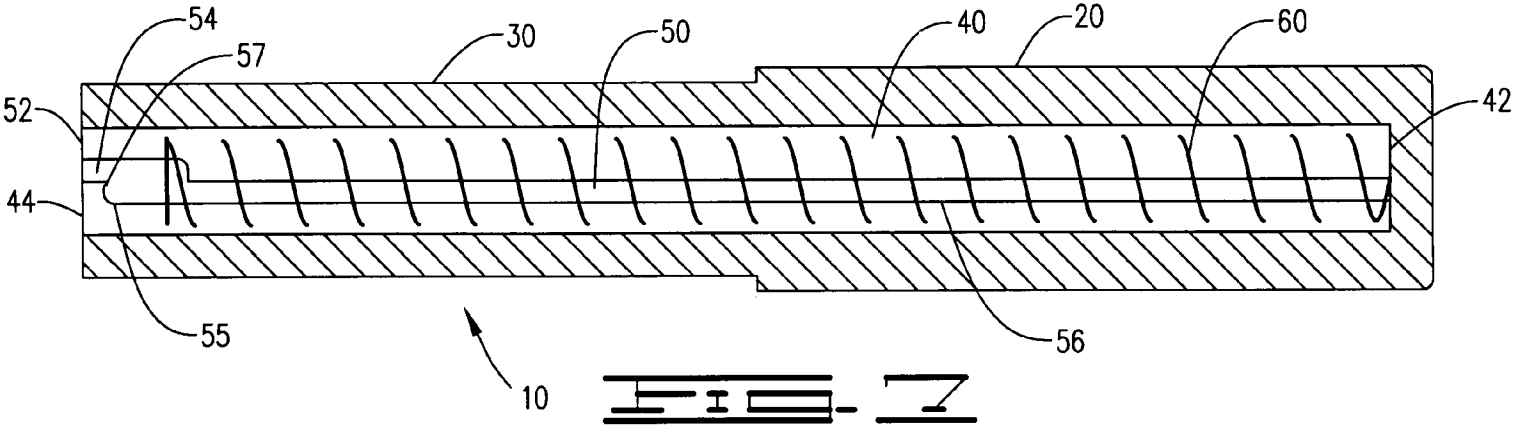
FIG. 7 is a longitudinal sectional view of the wire nut application tool along section lines 7/7 of FIG. 4.
Figure 8:
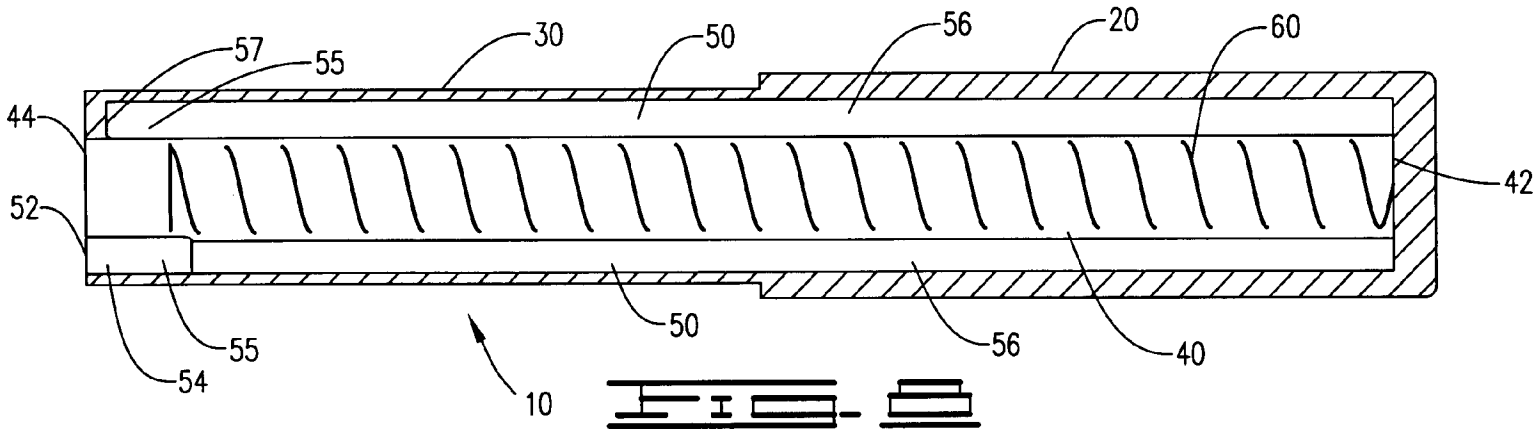
FIG. 8 is a longitudinal sectional view of the wire nut application tool along section lines 8/8 of FIG. 4.

As further indicated in the drawing figures, the linear grooves 50 are parallel and opposing, allowing the wire nut extensions 105 to slide freely and evenly within the hollow channel 40, with the wire nut connectors 100 being loaded within the hollow channel 40 to form a stored stack of wire nut connectors, FIG. 3, all the way into the hollow channel 40 into the extended interior segment 56 as allowed by the inner expansion spring 60. The offset groove shoulder 55 retains the last inserted wire nut connector 100 within the tool 10, with the other wire nut connectors 100 stacked on top of the lower or last inserted wire nut connector 100, providing for the tool 10 to be used for the application of a plurality of wire nut connectors 100 without having to insert the wire nut connectors 100 one at a time within the tool 10, as required in the prior art wire nut application tools. As shown in FIGS. 1 and 7, the offset groove shoulder 55 may further define a shoulder ridge 57, which is a slight upward transition between the offset groove shoulder 55 and the linear release slot 54 of each linear groove 50 to prevent the lateral dislocation of the connector extensions of the lowest wire nut connector from the offset groove shoulder until intended by the user during application of the wire nut connector to the wire bundle.

The tool 10 provides the user with the ability to apply several wire nut connectors 100 using a single hand and minimizes unnecessary repetitive movements of wire nut connector insertion. A typical wire nut connector 100 requires grasping the extensions 105 of the wire nut connector 100 between the thumb and forefinger and applying a twist using the wrist, with all the pressure of application and removal on the thumb pad and the inner portion of the forefinger. The tool 10 distributes the force and torque into the entire hand, using the grasp of the entire palm of the hand, reducing fatigue and pressure on smaller areas of the hands and fingers. The combined length of the expanded handle portion 20 and the lower tool portion 30 also provides the user with the ability to distance their hand from the channel opening 44 and the applied wire bundle upon which the wire nut connectors 100 are inserted, especially useful where the wire bundles may be subject to live electrical power at the time of the wire nut connector application. Therefore, it would be preferred that the materials used in the construction of the wire nut application tool 10 be non-conductive, with a preferred material being an insulated plastic material, with the exception of the inner expansion spring 60.

The application purpose of the tool 10 comprises the steps of directing the channel opening 44 of the lower tool portion 20 towards at least two bared wire ends into the exposed lowest wire nut connector 100, applying the lowest wire nut connector 100 within the tool channel opening 44 upon the at least two wires forming the wire bundle, twisting and connecting the wires together within the lowest wire nut connector 100, releasing the wire nut extensions 105 from the respective groove shoulders 55, eliminating the attached wire nut connector 100 from the tool 10 through the aligned linear release slots 54 which further advances the next wire nut connector 100 and its extensions downwards along the respective linear grooves 50 and placing the next wire nut connector's wire nut extensions 105 into the offset groove shoulder 55 for the application of the next wire nut connector 100 held within the tool 10. The tool 10 may be reloaded as many times as required throughout the life of the tool 10.

As there exist numerous sized wire nut connectors 100 for varied wire gauges and number of wires in a particular bundle, the tool 10 may be supplied in various different sizes to accommodate the various sized wire nut connectors 100. As shown in FIGS. 1 and 2 of the drawings, the wire nut application tool 10 is transparent. However, it would be further preferable to colorize all or some portion of the expanded handle portion 20 of the wire nut application tool 10 to coordinate the same color as is used in the industry to indicate the size of the wire nut connectors. It is preferred that the entire lower tool portion 30 of the wire nut application tool be transparent or at least translucent so that the user can see how many wire nut connectors 100 are contained within the hollow chamber 40 of the wire nut application tool 10. For example, wire nut connectors come in color coded sizes with yellow wire nut connectors being of one size, blue wire nut connectors being another size and the red wire nut connectors being yet another size, depending upon the inner diameter and gauge of the wire being connected within each wire nut connector. This tool is not recommend for use with wire nut connectors that do not have the disclosed two axially aligned wire nut extensions.

It is further contemplated that the handle portion 20 of the tool 10 may include a textured surface, a contoured outer surface, friction enhancing coatings or other means of improving the grip on the handle portion of the tool, not shown. It is also contemplated that the handle portion 20 may also include a recess in an upper end, not shown, containing a wire twisting device, including a plurality of spaces holes within which several wires may be inserted and rotated to twist them together prior to application of a wire nut connector 100 from the other end.

While the invention has been particularly shown and described with reference to a preferred embodiment thereof, it will be understood by those skilled in the art that changes in form and detail may be made therein without departing from the spirit and scope of the invention.

What is claimed is:

1. A wire nut application tool for the application and removal of individual electrical wire nut connectors and providing internal storage for a plurality of said wire nut connectors within said tool, said tool comprising:

an expanded handle portion and a lower tool portion defining a hollow channel defining a channel opening and housing an inner expansion spring which is biased against and attached to a channel end;

a pair of perpendicular and axially aligned linear grooves formed within said hollow channel, each said linear groove extending into said expanded handle portion, an offset groove shoulder and a laterally extending release slot forming a terminal end within said channel opening, wherein said individual and said plurality of wire nut connectors, which further define a pair of radially aligned wire nut extensions are loaded within said hollow channel with each wire nut extension slid into and retained within each respective linear groove originally into each respective terminal end of said linear groove and further into said extended interior segment against the force of said inner expansion spring, with the lowest said wire nut connector having said wire nut extensions contemporaneously held upon each respective said offset groove shoulder during application or removal upon an twisted applied wire bundle through rotation of said tool thereafter forcing the next said wire nut connector upon said offset groove shoulder for subsequent application and wherein each said offset groove shoulder forms a shoulder ridge with a slight upward transition between said offset groove shoulder and said linear release slot to prevent lateral dislocation of said connector extensions of said lowest wire nut connector from said offset groove shoulder until intended during application of said wire nut connector to said wire bundle.

2. The wire nut application tool as disclosed in claim 1, further comprising said expanded handle portion and said lower tool portion made from a non-conductive and transparent material revealing said hollow channel to determine how many said wire nut connectors are contained within said tool.

* * * * *